US006810591B2

(12) United States Patent
D'Estais

(10) Patent No.: US 6,810,591 B2
(45) Date of Patent: Nov. 2, 2004

(54) DRAWING AID DEVICE

(75) Inventor: Mathias D'Estais, Cairon (FR)

(73) Assignee: Heller S. A. (FR)

( * ) Notice: Subject to any disclaimer, the term of this patent is extended or adjusted under 35 U.S.C. 154(b) by 0 days.

(21) Appl. No.: 10/459,664

(22) Filed: Jun. 11, 2003

(65) Prior Publication Data

US 2004/0031161 A1 Feb. 19, 2004

Related U.S. Application Data

(63) Continuation of application No. PCT/FR01/03969, filed on Dec. 12, 2001.

(51) Int. Cl.[7] ..... B43L 13/14
(52) U.S. Cl. ..... 33/1 K; 33/20.3; 434/88
(58) Field of Search ..... 33/1 K, 18.3, 20.1, 33/20.2, 20.3, 20.4, 26, 432; 434/85, 88, 91

(56) References Cited

U.S. PATENT DOCUMENTS

| | | | | | |
|---|---|---|---|---|---|
| 657 | A | * | 3/1838 | Thompson | 33/20.3 |
| 561,797 | A | * | 6/1896 | Langworthy | 434/88 |
| 902,299 | A | * | 10/1908 | Johnson | 434/88 |
| 1,227,978 | A | * | 5/1917 | Thomson | 33/20.3 |
| 1,518,680 | A | * | 12/1924 | Arnot | 434/85 |
| 2,369,634 | A | * | 2/1945 | Talbert et al. | 33/20.4 |
| 2,387,021 | A | * | 10/1945 | Hendershot | 434/88 |
| 2,418,286 | A | | 4/1947 | Austin | 434/85 |
| 2,535,213 | A | * | 12/1950 | Kail | 33/20.4 |
| 4,026,631 | A | * | 5/1977 | Erb | 33/20.4 |
| 4,571,835 | A | | 2/1986 | Nishio | 33/20.1 |
| 5,671,091 | A | * | 9/1997 | Monroe et al. | 434/85 |
| 2004/0031161 | A1 | * | 2/2004 | D'Estais | 33/1 K |

FOREIGN PATENT DOCUMENTS

| | | |
|---|---|---|
| FR | 2164555 | 8/1973 |

* cited by examiner

*Primary Examiner*—G. Bradley Bennett
(74) *Attorney, Agent, or Firm*—Piper Rudnick LLP

(57) ABSTRACT

A device enabling a user to reproduce an observed scene on a drawing board support including a first mirror; at least one second mirror, the mirrors being arranged to transmit an image from the support onto an eyepiece in front of which the user can position a first eye; and a secondary support capable of being intercalated between the scene and a second eye to be able to handle a close scene.

23 Claims, 9 Drawing Sheets

1

29
28
25/26
25
26
P

DRAWING AID DEVICE

RELATED APPLICATION

This is a continuation of International Application No. PCT/FR01/03969, with an international filing date of Dec. 12, 2001, which is based on French Patent Application No. 00/16183, filed Dec. 12, 2000.

FIELD OF THE INVENTION

This invention pertains to the field of drawing aid devices. More particularly, the invention pertains to a device enabling the user to reproduce an observed scene on a drawing board support.

BACKGROUND

Drawing aid devices are already known in the prior art, notably from FR 2 757 667, which pertains to a portable device for the execution of drawings comprising an objective and a mirror which reflects the image captured by the objective onto a flat-positioned screen. Although this device makes it possible to reproduce a scene, it is not of great value regarding learning how to draw because it does not allow interpretation of the scene. The technique is most suited for copying a work of art with tracing paper applied to it.

Also known in the prior art is FR 2 164 555, which pertains to a device comprised of two mirrors enabling the user to reproduce an observed scene on a drawing board support. This device has the major disadvantage of not being suitable for reproducing a plane image from a book or a reproduction. Moreover, the device is positioned essentially in relation to the luminosity problems of the object to be reproduced. This type of problem is only posed for natural scenes and is not posed with images.

It would, therefore, be advantageous to provide an aid device for drawings or paintings based on the capacity of human vision to accept the superposition of images which appear to be in the same plane by means of mirrors. Such a device would be advantageous for the drawer or painter to learn to evaluate perspectives and reproduce in a simple and effective manner both scenes in perspective and plane representations.

SUMMARY OF THE INVENTION

This invention relates to a device enabling a user to reproduce an observed scene on a drawing board support including a first mirror, at least one second mirror, the mirrors being arranged to transmit an image from the support onto an eyepiece in front of which the user can position a first eye, and a secondary support capable of being intercalated between the scene and a second eye to be able to handle a close scene.

BRIEF DESCRIPTION OF THE DRAWINGS

Better understanding of the invention will be obtained from the description below, provided for purely explanatory purposes, of one mode of implementation of the invention with reference to the attached figures.

DETAILED DESCRIPTION

Figure 1:
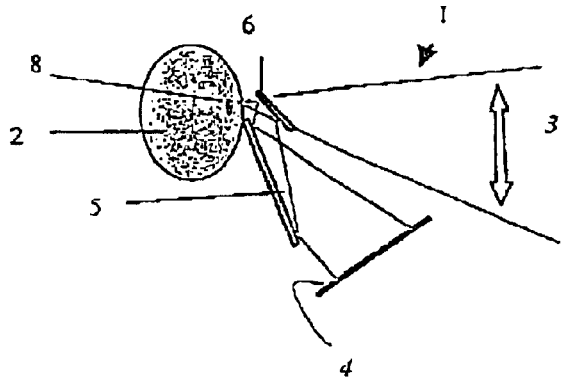
FIG. 1 is a side view of the outline diagram of the base device according to aspects of the invention.
Figure 2:
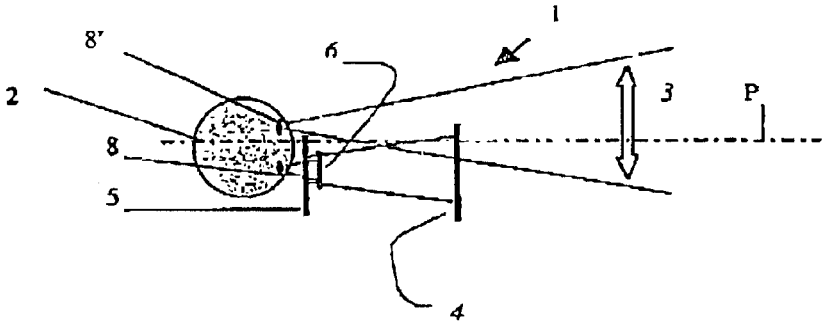
FIG. 2 is a top view of the outline diagram of the base device according to aspects of the invention.
Figure 3:
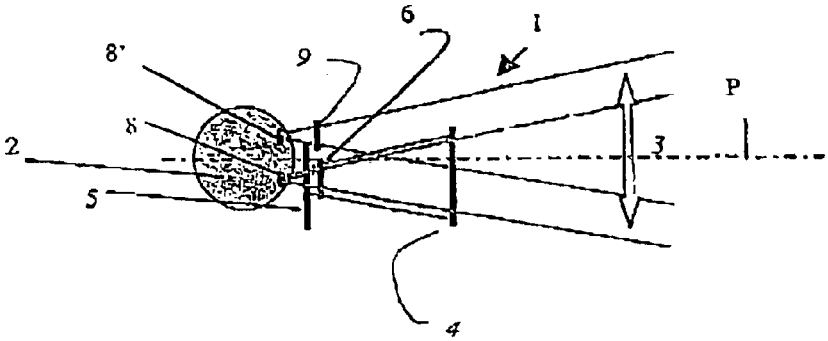
FIG. 3 is a top view of the outline diagram of the device according to aspects of the invention equipped with a filter.

It will be appreciated that the following description is intended to refer to specific embodiments of the invention selected for illustration in the drawings and is not intended to define or limit the invention, other than in the appended claims.

The reproduction device according to the invention comprises a secondary support for the reproduction of plane images, capable of being intercalated between the scene and a second eye to handle a close scene.

In another aspect, the secondary support is constituted of a transparent element and one or more mobile support rod(s) applied against the rear surface of the transparent element by means of one or more springs to enable reproduction of models presented, for example, in thick books.

In another aspect of the device, the invention comprises adjustment means enabling translational movement of the secondary support on the device.

In yet another aspect of the invention, the device is constituted of a hollow central part, the support and the second support being articulated at the base of the central part to allow it to close and thereby form a briefcase. The central part preferably comprises a means for adjusting the height of the eyepiece. The device, moreover, preferably comprises a handle to facilitate holding it.

In one version of the invention, the handle is the first mirror forming a single piece which is rotationally mobile in relation to the central part. The first mirror and the second mirror are perpendicular to the same longitudinal plane and are offset from each other by an angle of about 20 degrees. The second mirror—which is closer to the eye—can be a semitransparent mirror to also allow the first eye to visualize the scene.

The device can comprise at least one second eyepiece equipped with a filter which can be positioned in front of a second eye to diminish the luminosity of the scene perceived by the second eye. The device can also comprise at least one second eyepiece associated with at least two scene mirrors enabling transmission of an image of the scene to a second eye. This second eyepiece can be mobile in relation to the first eyepiece to allow the user the freedom to select which eye—right or left—to be positioned in front of the first eyepiece and which eye is to be positioned in front of the second eyepiece. The first mirror and/or the second mirror is (are) preferably of trapezoidal form to free up the maximum amount of space for the movement of the hands and arms.

The first eyepiece and/or the second eyepiece can moreover comprise means for the enlargement or reduction of the perceived image. The support is inclined by an angle of about 60° in relation to the first mirror and by an angle of about 47° in relation to a reference plane of the device. The first mirror and/or the second mirror can have means for regulating their surface flatness to enable changing the scale of the perceived image.

The device, moreover, preferably comprises means making it possible to vary the distance(s) between the first mirror and/or the second mirror and/or the support in the same longitudinal plane.

The device according to the invention advantageously makes it possible to create drawings or paintings due to the fact that the images of the scene to be reproduced and the support of the reproduction are superposed in front of the eyes. This device, thus, becomes a tool for learning how to draw and paint for children or adults.

The device according to the invention is advantageously portable and can be adapted to the luminosity of the scene observed and make it possible to vary the size of the scene observed and/or of the support.

Turning now to the drawings, the device (1) illustrated schematically in FIG. 1 is a device enabling a user (2) to reproduce an observed scene (3) on a drawing board support (4) by the principle of differentiation of the images perceived by each of the eyes, the device being of the type comprising a mirror (5).

The device (1) comprises at least one second mirror (6), the mirrors (5, 6) being positioned to transmit the image from the support (4) onto an eyepiece (7) in front of which the user (2) can place a first eye (8). The first eye (8) of the user (2) thus perceives the support, the image of which is transmitted to the site by the first mirror (5) and the second mirror (6) and the second eye (8') of the user (2) perceives the scene (3) directly.

When the first eye (8) is placed in front of the eyepiece (7) and the second eye (8') observes the scene (3), human binocular vision causes the images of the support (4) and the scene (3) to be superposed, thereby enabling the reproduction of the scene (3) on the support (4).

Figure 4:
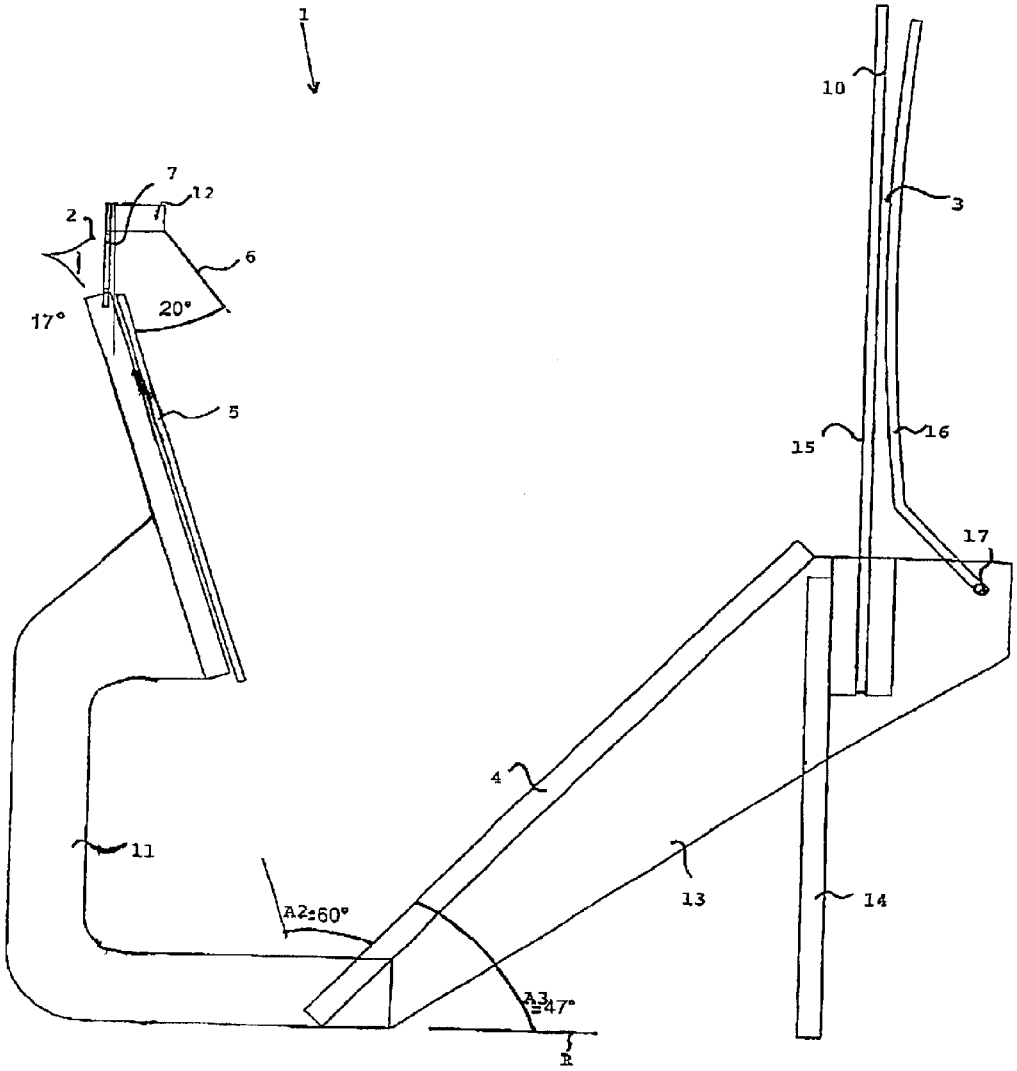
FIG. 4 is a side view of a variant of the device according to aspects of the invention.

The first mirror (5) and the second mirror (6) are preferably perpendicular to a given longitudinal plane P and are offset from each other by an angle A1 of 20 degrees as shown in FIG. 4.

In a variant, the second mirror (6), the mirror that is closer to the eye (8), is preferably a semitransparent mirror or an unsilvered mirror—so that the eye (8) can also view the scene (3) via the eyepiece (7). In this variant, it is therefore not necessary that the second eye (8') observe the scene (3) since the first eye (9) perceives both the scene (3) and the support (4). The focalization of the eyes (8, 8') is simplified and the observation comfort is enhanced.

In another variant, the device (1) comprises at least one second eyepiece (7') equipped with a filter (9) which can be positioned in front of the second eye (8') to diminish the luminosity of the scene (3). This device is particularly useful in the reproduction of scenes illuminated by natural daylight. It is possible to propose a range of filters having different degrees of filtration.

Figure 5:
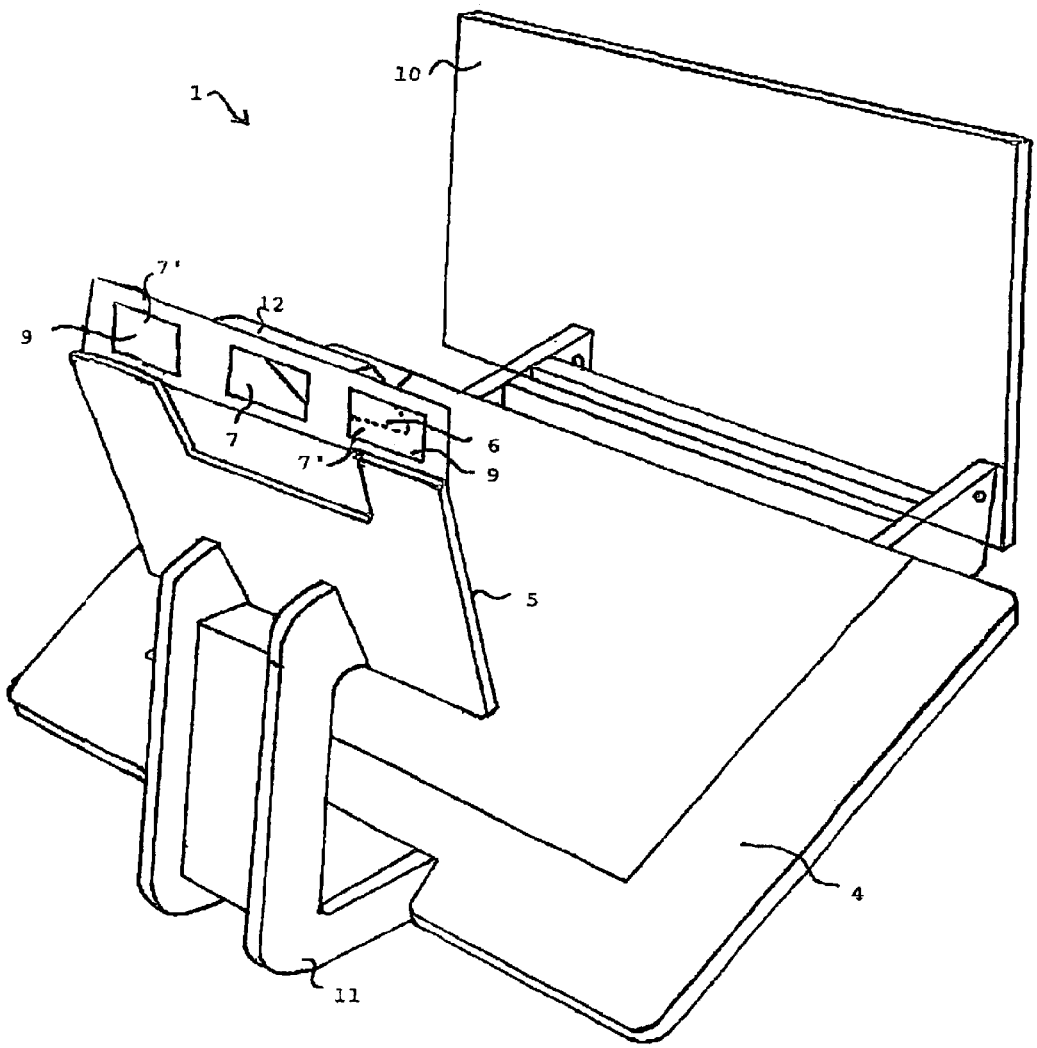
FIG. 5 is a perspective view of a variant of the device according to aspects of the invention.

In the variant of FIG. 5, the device (1) is equipped with two eyepieces (7') arranged on both sides of the eyepiece (7) to allow the user to decide whether to use the left or right eye for viewing through the first eyepiece (7).

In still another variant, the device (1) comprises at least one second eyepiece (7') associated with at least two scene mirrors enabling transmission of a scene image (3) to a second eye (8'). The second eyepiece (7') is unique and mobile in relation to the first eyepiece (7), i.e., it can be positioned to the right or to the left of the eyepiece (7), for example, by rotation around the contour of the eyepiece (7). The first mirror (5) and second mirror (6) preferably have a trapezoidal form to not block the field of vision of the eye (8') and open up the space for passage of the user's hands and arms. The second mirror (6) is smaller than the first mirror (5) to reduce the bulk of the device (1). The second mirror (6) transmits precisely the image from the first mirror (5) to the eyepiece (7). The larger base of the two mirrors (5, 6) is positioned downward. The first eyepiece (7) and/or second eyepiece (7') can moreover comprise means for enlarging or reducing the image perceived or the images perceived by the eye or the eyes.

It is thus possible for the implemented reproduction to not be completely faithful to the observed scene if the user so desires. These means for the enlargement or reduction of the perceived image can be constituted by lenses positioned at the level of one or more eyepieces (7, 7'). These lenses are preferably removable and form a range of enlargement and reduction.

The first mirror (5) and/or second mirror (6) can have means to adjust their surface flatness which also constitute means for varying the size of the image or the images perceived by the eye or eyes. These means can be constituted, for example, of one or more screws each associated with a thread and the movements of which in relation to the threads cause deformation of the reflective or semi-reflective surface of the first mirror (5) and/or the second mirror (6).

The device (1) can also comprise means making it possible to vary the distance(s) between the first mirror (5) and/or second mirror (6) and/or the support (4) along a longitudinal plane P which also constitute means for varying the size of the image(s) perceived by the eye(s).

All of these means described for modifying the proportions of the perceived images and thus the proportions of the work executed on the support (4) can also be employed to deform the images and thereby generate special graphic effects.

The support (4) is inclined by an angle A2 of 60° in relation to said first mirror (5) and by an angle A3 of 47° in relation to a reference plane R of the device (1). Thus, the first mirror (5) is inclined in relation to the vertical by an angle A4 of 17°. The angles A1, A2, A3 and A4 are specified with a precision on the order of about 3 degrees.

In the version illustrated in FIGS. 4 and 5, a first arm (11) maintains the first mirror (5) in relation to the support (4) and a second arm (12) maintains the second mirror (6) in relation to the first mirror (5). It is important to note that the reference plane R is illustrated as being horizontal, but it is not necessarily the case given that the device (1) is portable.

Figure 6:
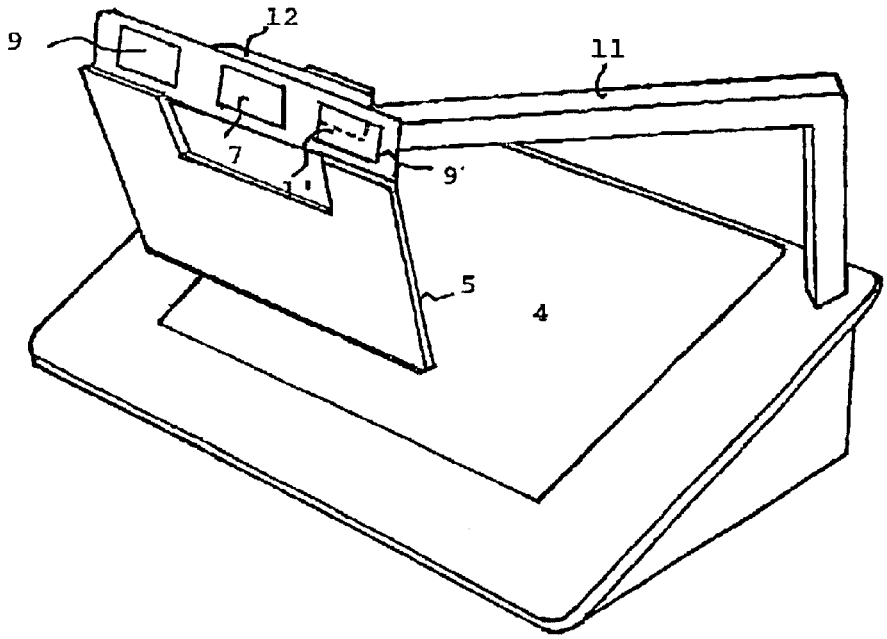
FIG. 6 is a perspective view of another variant of the device according to aspects of the invention.

In the version illustrated in FIG. 6, the first arm (11) not only maintains the first mirror (5) in relation to the support (4), but also the eyepiece assembly (7, 7'). The device (1) can moreover also comprise a standard positioning nut to allow attachment to a tripod. The device (1) further-more comprises a secondary support (10) for the reproduction of plane images that can be intercalated between the scene (3) and the second eye (8') to handle a close scene (3'). The secondary support (10) is maintained on the rest of the device (1) by means of a third arm (13) and possibly a retractable reinforcement (14).

In a preferred version, the secondary support (10) is constituted of a transparent element (15) and one or more mobile support rods (16) held against the rear surface of the transparent element (15) by means of one or more spring(s) (17). This version makes it possible to position a book or magazine against the transparent element (15) and to thereby have available a plane scene (3') which would not be the case-especially in the case of thick books-if the model were merely placed on the front surface of the secondary support (10).

The device (1) moreover preferably comprises adjustment means allowing the translational movement of the secondary support (10) on the device (1). These adjustment means can be constituted, for example, of one or more freely rotating worm screws each cooperating with a nut positioned at the base of the secondary support (10).

The device (1) can furthermore have a multiplicity of facets so that it can be positioned at different angles in relation to the horizontal. This can facilitate the reproduction of a scene or object positioned close to the device (1). The facets can be provided, for example, on the bottom surface of the support (4) or the third arm (13). The device (1) is preferably implemented by means of flexible and/or removable elements.

Figure 7:
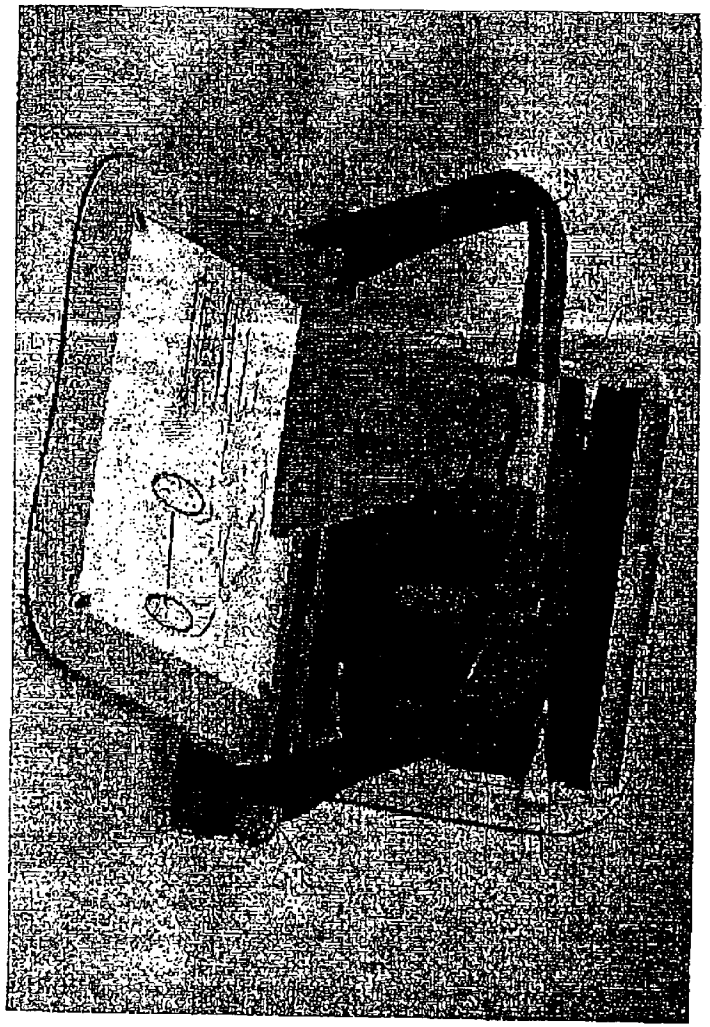
FIG. 7 is a front perspective view of a variant of the device according to aspects of the invention that can be closed so as to form a briefcase.
Figure 8:
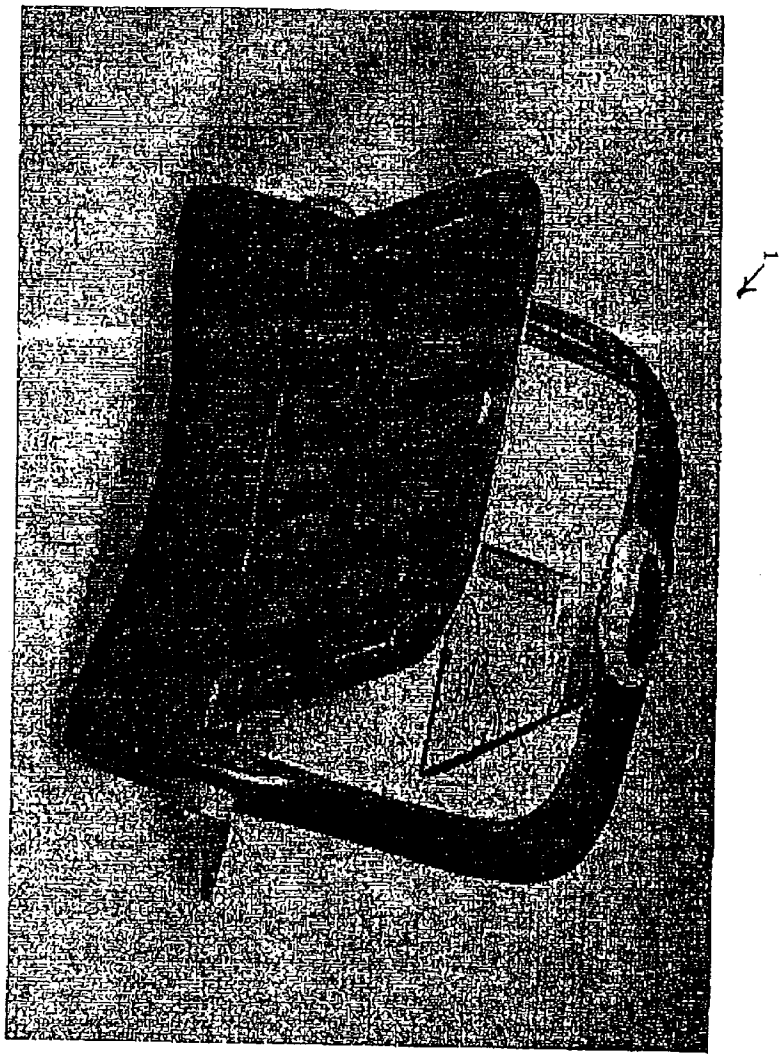
FIG. 8 is a rear perspective view of the device of FIG. 7.
Figure 9:
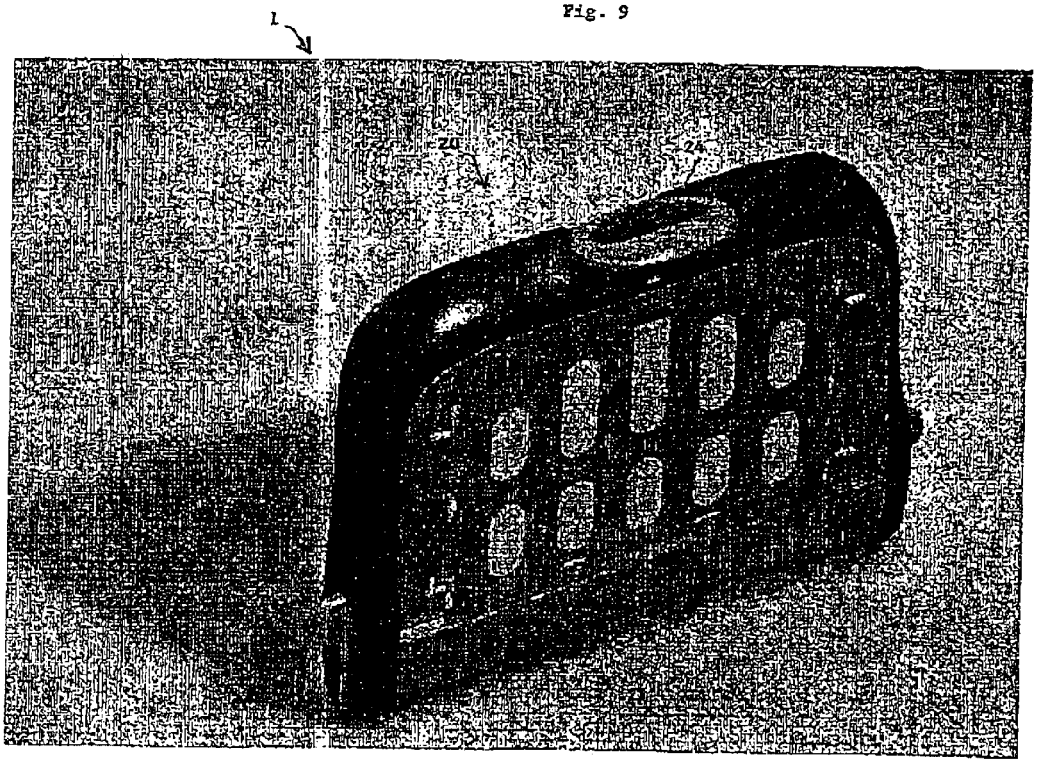
FIG. 9 is a perspective view of the device of FIGS. 7 and 8 in a closed position.

In a variant of the invention illustrated in FIGS. 7 to 9, the device (1) has a storage state in the form of a briefcase (20). The device (1) is constituted of a central hollow part (21) creating an arch, the support (4) and the secondary support (10) being articulated at the base of this central part (21) so that it can be closed and form the briefcase. The support (4) and the secondary support (10) thus form the side walls of the briefcase and the central part (21) forms the perimeter.

Figure 10:
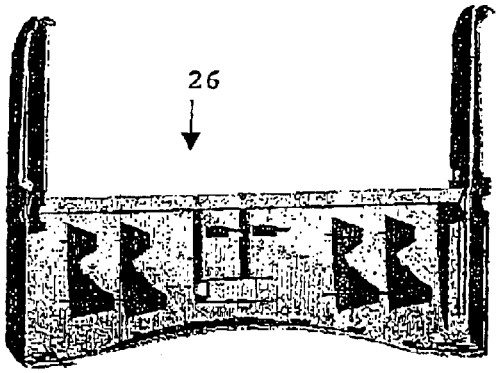
FIG. 10 is a front foot for the device of FIGS. 7 and 8.
Figure 11:
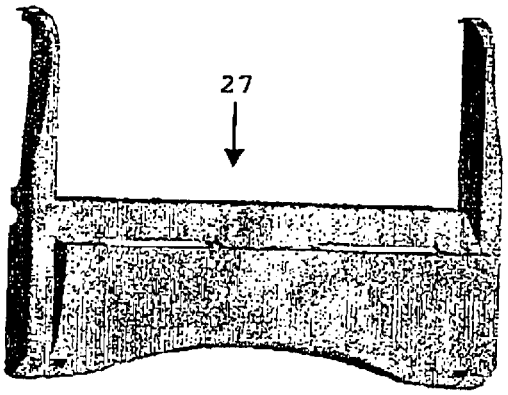
FIG. 11 is a rear foot for the device of FIGS. 7 and 8.

The central part (21) is constituted of a front foot (26), illustrated in FIG. 10, and a rear foot (27), illustrated in FIG. 11, assembled by means of a cross piece not illustrated in detail.

Figure 12:
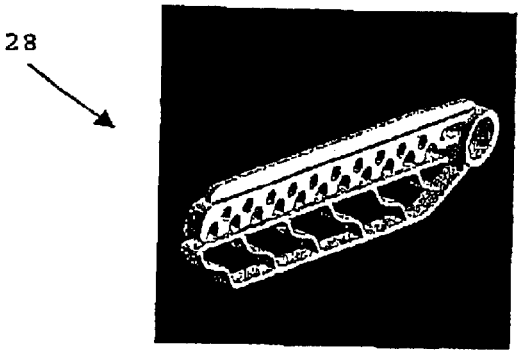
FIG. 12 is a rack for the device of FIGS. 7 and 8.
Figure 13:
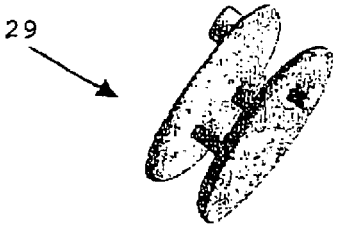
FIG. 13 is a driving part for the device of FIGS. 7 and 8.

The central part (21) has a means (22) for adjusting the height of the eyepiece (7) without changing the orientation of the mirrors (5, 6) in relation to each other and in relation to the support (4). This adjustment means (22) is constituted of a button which can be rotated. The button is designed to cooperate with a rack (28), illustrated in FIG. 12, and cause the rotation of a driving piece (29), illustrated in FIG. 13, as can be seen in FIGS. 14 to 18.

Figures 14, 15, 16, 17, 18:
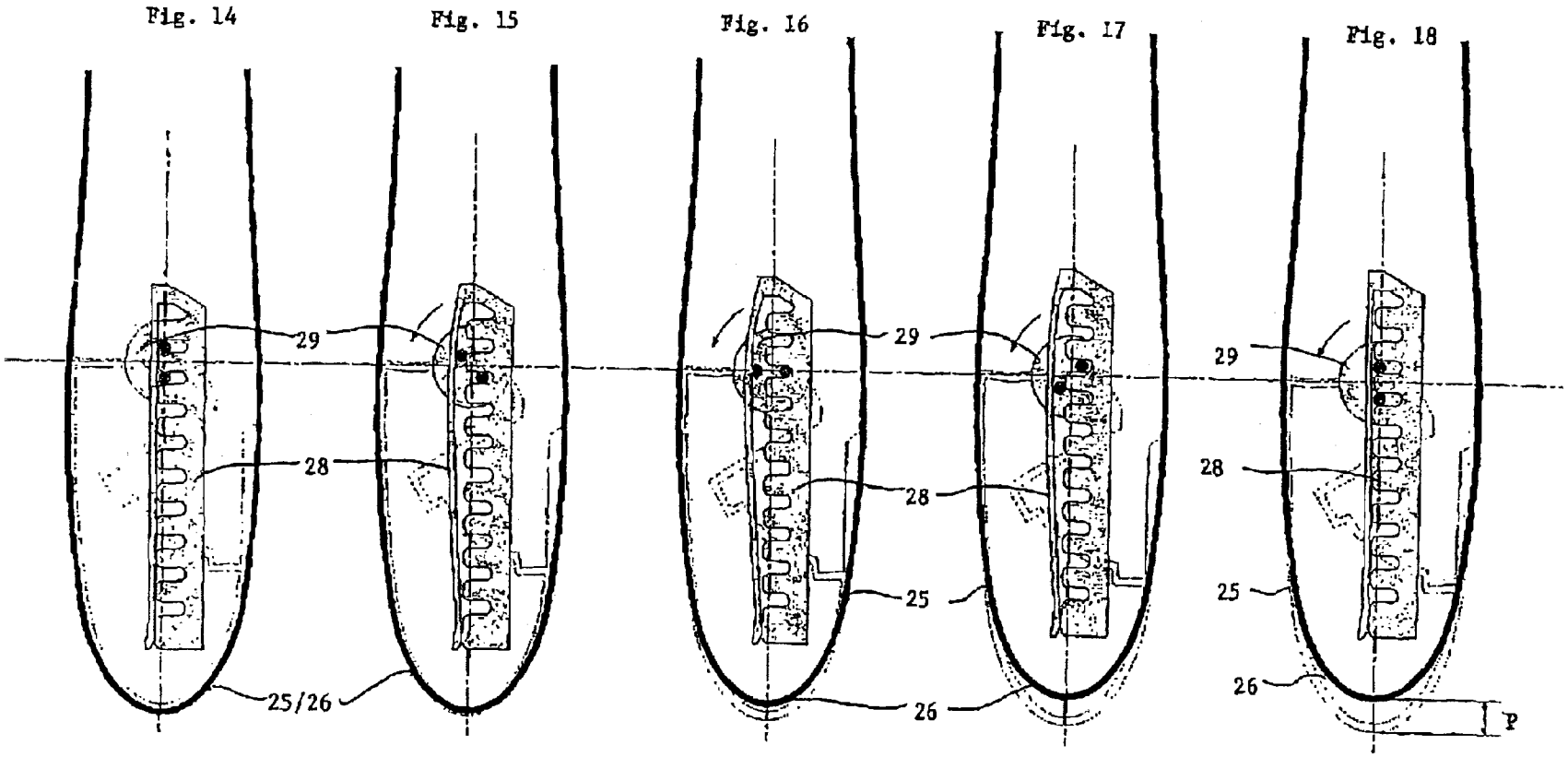
FIGS. 14 to 18 show the movement of the driving part in relation to the rack upon rotation of the adjustment means.

FIG. 14 illustrates a resting position. FIGS. 15 to 17 illustrate rotation of the driving piece (29) and the rising of the rack (28). FIG. 18 shows a new resting position in which a foot (25, 26) was set apart by a distance P of about 10 millimeters in relation to the other foot. The rack (28) and the driving piece (29) are housed inside the feet. The rack (28) cooperates with at least one tappet formed inside one of the feet. The device (1) moreover has a handle (24) to facilitate holding it.

In one version, the handle (24) and the first mirror (5) form a single piece which can be rotated along the central part (21). Thus, when the handle is retracted against the central part (21), the mirror (5) is exactly positioned for the reflection of scenes and when the mirror (5) is folded under the transverse piece of the arch, the handle (24) is raised up.

The invention was described above as an example. It is understood that one of ordinary skill in the art would be able to implement different variants of the invention without going beyond the scope of the patent which is defined in the appended claims.

What is claimed is:

1. A device enabling a user to reproduce an observed scene on a drawing board support comprising:

a first mirror;

at least one second mirror, the mirrors being arranged to transmit an image from the support onto an eyepiece in front of which the user can position a first eye; and a secondary support that intercalates between the observed scene and a second eye.

2. The device according to claim 1, wherein the secondary support comprises a transparent element and a mobile support rod held against a rear surface of the transparent element by a spring.

3. The device according to claim 1, further comprising adjustment means enabling translational movement of the secondary support on the device.

4. The device according to claim 1, further comprising a hollow central part, wherein the drawing board support and the secondary support are articulated at a base portion of the central part so that it can be closed.

5. The device according to claim 4, wherein the central part comprises a means for adjusting the height of the eyepiece.

6. The device according to claim 4, further comprising a handle as part of the first mirror.

7. The device according to claim 6, wherein the handle and the first mirror form a single piece which is rotationally mobile in relation to the central part.

8. The device according to claim 1, wherein the first mirror and the second mirror are perpendicular to a longitudinal plane P and are offset by an angle A1 of about 20 degrees.

9. The device according to claim 1, wherein the second mirror is a semitransparent mirror.

10. The device according to claim 1, further comprising a second eyepiece equipped with a filter which can be positioned in front of a second eye.

11. The device according to claim 1, further comprising a second eyepiece associated with two scene mirrors enabling transmission of an image of the scene to a second eye.

12. The device according to claim 10, wherein the second eyepiece is mobile in relation to the first eyepiece.

13. The device according to claim 11, wherein the second eyepiece is mobile in relation to the first eyepiece.

14. The device according to claim 1, wherein the first mirror and the second mirror are of trapezoidal form.

15. The device according to claim 1, wherein the first eyepiece and second eyepiece comprise(s) means for enlarging or reducing a perceived image.

16. The device according to claim 1, wherein the support is inclined by an angle A2 of about 60° in relation to the first mirror.

17. The device according to claim 1, wherein the support is inclined by an angle A1 of about 47° in relation to a reference plane R of the device.

18. The device according to claim 1, wherein the first mirror and the second mirror has (have) means for adjusting surface flatness.

19. The device according to claim 1, further comprising means making it possible to vary distance(s) between the first mirror and the second mirror and the support along a longitudinal plane P.

20. The device according to claim 1, wherein the first mirror or the second mirror has (have) means for adjusting surface flatness.

21. The device according to claim 1, further comprising means making it possible to vary distance(s) between the first mirror or the second mirror or the support along a longitudinal plane P.

22. The device according to claim 1, wherein the first mirror or the second mirror are of trapezoidal form.

23. The device according to claim 1, wherein the first eyepiece or second eyepiece comprise(s) means for enlarging or reducing a perceived image.

* * * * *